US012790915B1

(12) United States Patent
Dave et al.

(10) Patent No.: US 12,790,915 B1
(45) Date of Patent: Nov. 10, 2026

(54) DOWNHOLE TOOL HAVING RELEASE STROKE AMPLIFICATION

(71) Applicant: Halliburton Energy Services, Inc., Houston, TX (US)

(72) Inventors: Jalpan Piyush Dave, Singapore (SG); Michael Fripp, Houston, TX (US); Paul James, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/366,229

(22) Filed: Oct. 22, 2025

(51) Int. Cl.
*E21B 34/10* (2006.01)

(52) U.S. Cl.
CPC ..... *E21B 34/10* (2013.01)

(58) Field of Classification Search
CPC ..... E21B 34/14; E21B 34/10; E21B 34/06; E21B 34/00
See application file for complete search history.

(56) References Cited

U.S. PATENT DOCUMENTS 4,545,433 A 10/1985 Wambaugh
4,756,372 A * 7/1988 Airey ..... E21B 34/14 166/373
5,101,904 A 4/1992 Gilbert
5,101,907 A * 4/1992 Schultz ..... E21B 23/0412 166/336
5,429,036 A 7/1995 Latos
6,073,708 A 6/2000 Brown et al.
6,289,998 B1 9/2001 Krueger et al.
6,796,120 B2 9/2004 Franchet et al.
7,051,526 B2 5/2006 Geiger
7,117,949 B2 10/2006 Doane et al.
7,134,499 B2 11/2006 Wilson et al.
(Continued)

FOREIGN PATENT DOCUMENTS

BR 112021007440 A2 7/2021
EP 0661459 A1 7/1995
(Continued)

OTHER PUBLICATIONS

Enerpac. "Pascal's Law and Hydraulic Tools." Enerpac Company Website, https://blog.enerpac.com/pascals-law-and-hydraulic-tools/. Accessed May 14, 2025.
(Continued)

*Primary Examiner* — Daniel P Stephenson
(74) *Attorney, Agent, or Firm* — Scott Richardson; C. Tumey Law Group, PLLC

(57) ABSTRACT

Provided herein are various examples of downhole tools having a tool actuator which moves through a release stroke distance and a work stroke distance, and a first hydraulic actuator configured to produce forces which are applied to the tool actuator, and wherein the first hydraulic actuator is further configured such that the forces produced by the first hydraulic actuator are transferred to the tool actuator and amplified at the tool actuator when the tool actuator is moving through the release stroke distance and the forces produced by the first hydraulic actuator are transferred directly without being amplified at the tool actuator when the tool actuator is moving through the work stroke distance.

20 Claims, 12 Drawing Sheets

(56) References Cited

U.S. PATENT DOCUMENTS

| | | | | |
|---|---|---|---|---|
| 7,614,454 | B2 * | 11/2009 | Buyers | E21B 34/08 166/386 |
| 8,281,767 | B2 | 10/2012 | Kuhnke et al. | |
| 9,121,250 | B2 | 9/2015 | Godfrey et al. | |
| 9,383,029 | B2 | 7/2016 | Scott | |
| 9,551,200 | B2 | 1/2017 | Read et al. | |
| 9,702,229 | B2 | 7/2017 | Zhou | |
| 10,066,466 | B2 | 9/2018 | Radtke | |
| 10,132,135 | B2 | 11/2018 | Gaude | |
| 10,563,676 | B1 | 2/2020 | Theobald | |
| 10,883,332 | B2 | 1/2021 | Zhao et al. | |
| 11,261,697 | B2 | 3/2022 | Tusing et al. | |
| 12,473,795 | B2 * | 11/2025 | Dave | E21B 23/06 |
| 12,644,351 | B1 | 6/2026 | Thangarajoo et al. | |
| 2002/0070015 | A1 | 6/2002 | Armell et al. | |
| 2004/0028543 | A1 | 2/2004 | Rapp | |
| 2005/0091972 | A1 | 5/2005 | Redman | |
| 2008/0111431 | A1 | 5/2008 | Dorel | |
| 2009/0159290 | A1 | 6/2009 | Lauderdale | |
| 2011/0232474 | A1 * | 9/2011 | Geiger | E21B 33/06 91/159 |
| 2013/0000922 | A1 | 1/2013 | Skinner et al. | |
| 2013/0118758 | A1 | 5/2013 | Caminari | |
| 2014/0048288 | A1 | 2/2014 | Clemens et al. | |
| 2015/0136393 | A1 * | 5/2015 | Turley | E21B 23/00 166/382 |
| 2016/0258252 | A1 | 9/2016 | Fripp et al. | |
| 2016/0273305 | A1 | 9/2016 | Murphree et al. | |
| 2016/0326804 | A1 | 11/2016 | Gao | |
| 2017/0248009 | A1 | 8/2017 | Fripp et al. | |
| 2017/0321515 | A1 * | 11/2017 | Stæhr | E21B 33/1277 |
| 2017/0343019 | A1 | 11/2017 | Thomson et al. | |
| 2018/0305999 | A1 | 10/2018 | Dave et al. | |
| 2019/0112895 | A1 | 4/2019 | Greci et al. | |
| 2019/0120258 | A1 | 4/2019 | Zavadinka | |
| 2019/0271332 | A1 | 9/2019 | Todsen et al. | |
| 2021/0071501 | A1 | 3/2021 | Minassa et al. | |
| 2021/0102440 | A1 | 4/2021 | Minassa et al. | |
| 2023/0072189 | A1 | 3/2023 | Mothilal et al. | |
| 2023/0272685 | A1 | 8/2023 | Dave et al. | |
| 2024/0318519 | A1 | 9/2024 | Provost | |
| 2024/0426190 | A1 | 12/2024 | Eldho et al. | |
| 2025/0084736 | A1 | 3/2025 | Vasques | |
| 2025/0223882 | A1 | 7/2025 | Dave et al. | |

FOREIGN PATENT DOCUMENTS

| | | | |
|---|---|---|---|
| GB | 2552994 | A | 2/2018 |
| JP | H05187404 | A | 7/1993 |
| NO | 179880 | B | 9/1996 |
| NO | 335376 | B1 | 12/2014 |
| RU | 2184281 | C2 | 6/2002 |
| VN | 10043692 | B | 2/2025 |
| WO | 1999035365 | A2 | 7/1999 |
| WO | 2017203288 | A1 | 11/2017 |
| WO | 2019089487 | A1 | 5/2019 |

OTHER PUBLICATIONS

Retsetman YouTube Video. "3D printed Gearbox powered Linear Actuator | High Torque." Uploaded Jan. 11, 2011. YouTube Website, https://www.youtube.com/watch?v=NLscbeoljAY. Accessed May 14, 2025.

ScienceWorld YouTube Video. "How a hydraulic jack works (3D Animation | Pascal Principle)." Uploaded Apr. 25, 2021. YouTube Website, https://www.youtube.com/watch?v=42dtoqUKY8l. Accessed May 14, 2025.

Saifullah, A.Z.A. et al. "Design, Construction and Performance Test of a Hydraulic Pressure Intensifier." The Experiment International Journal of Science and Technology, vol. 18, No. 3, Jan. 2014, pp. 1268-1283. PDF file. 17 pages.

Halliburton. "HS Interval Control Valves." Halliburton Data Sheet, 2024. H06970 Nov. 2024. PDF file. 3 pages.

U.S. Appl. No. 63/781,569, filed Apr. 1, 2025.

U.S. Appl. No. 19/040,555, filed Jan. 29, 2025.

Notice of Allowance for U.S. Appl. No. 19/366,242 dated Jun. 24, 2026. PDF file. 17 pages.

International Search Report and Written Opinion for International Patent Application No. PCT/US2025/058162 dated Jul. 9, 2026. PDF file. 7 pages.

Non-Final Office Action for U.S. Appl. No. 19/366,212 dated Jul. 10, 2026. PDF file. 22 pages.

International Search Report and Written Opinion for International Patent Application No. PCT/US2025/058157 dated Jul. 15, 2026. PDF file. 9 pages.

International Search Report and Written Opinion for International Patent Application No. PCT/US2025/058173 dated Jul. 16, 2026. PDF file. 7 pages.

International Search Report and Written Opinion for International Patent Application No. PCT/US2025/058176 dated Jul. 16, 2026. PDF file. 6 pages.

* cited by examiner

DOWNHOLE TOOL HAVING RELEASE STROKE AMPLIFICATION

BACKGROUND

In the resource recovery industry, there is often need to control tools using electric or electro-hydraulic actuators. These actuators need to generate significant power to actuate the downhole tools, yet they must fit into extremely tight spaces due to the physical constraints of the wellbore. Generally speaking, the smaller an actuator, the smaller the force/pressure it can generate. There is therefore a need to be able to use small and compact actuators and yet be able to actuate downhole tools in harsh environments.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
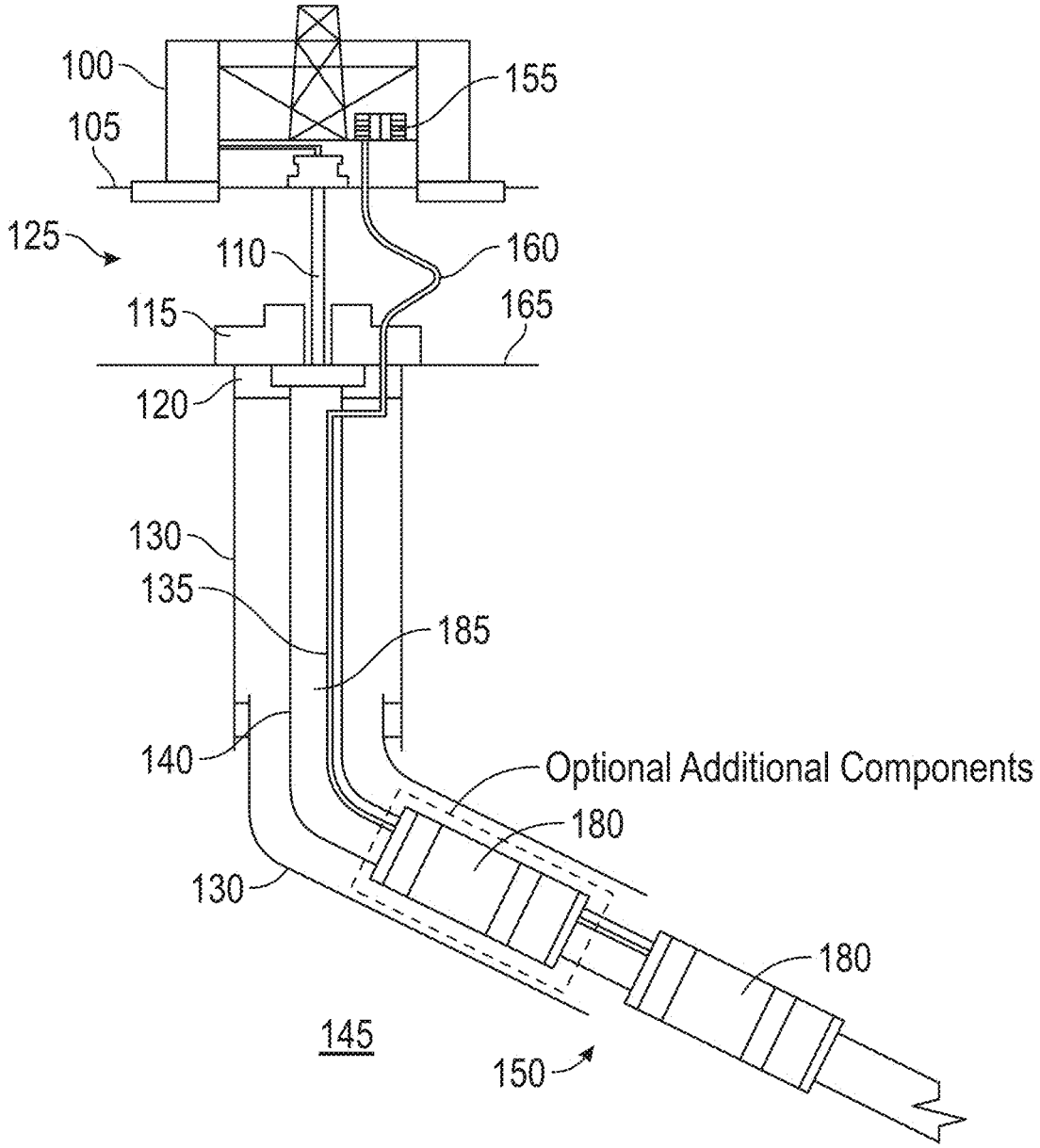
FIG. 1 illustrates a schematic view of a well system that may employ the principles of the present disclosure within one or more downhole tools.

Provided herein are various examples of downhole tools having a tool actuator which moves through a release stroke distance and a work stroke distance, and a first hydraulic actuator configured to produce forces which are applied to the tool actuator, and wherein the first hydraulic actuator is further configured such that the forces produced by the first hydraulic actuator are transferred to the tool actuator and amplified at the tool actuator when the tool actuator is moving through the release stroke distance and the forces produced by the first hydraulic actuator are transferred directly without being amplified at the tool actuator when the tool actuator is moving through the work stroke distance.

Further downhole tools are provided wherein the release stroke distance is measured between a metal to metal seal and the tool actuator. Further downhole tools are provided wherein the work stroke distance is at least three times longer in length than the release stroke distance. Further downhole tools are provided comprising a second hydraulic actuator configured to produce forces which are applied to the tool actuator in addition to the forces produces by the first hydraulic actuator only when the tool actuator is moving through the release stroke distance. Further downhole tools are provided wherein the second hydraulic actuator is configured such that it does not produce any forces which are applied to the tool actuator when the tool actuator is moving through the release stroke distance.

Further downhole tools are provided further comprising a releasable coupling positioned where a portion of the first hydraulic actuator overlaps with a portion of the tool actuator. Further downhole tools are provided further comprising a shoulder positioned on the first hydraulic actuator, and another shoulder positioned on the tool actuator and sized to engage with the shoulder on the first hydraulic actuator. Further downhole tools are provided wherein the first hydraulic actuator slides along the tool actuator when the tool actuator is moving through the release stroke distance, and the shoulder on the first hydraulic actuator catches the shoulder on the tool actuator when the tool actuator is moving through the work stroke distance. Further downhole tools are provided further comprising a releasable coupling which is disengaged when the tool actuator is moving through the release stroke distance and engaged when the tool actuator is moving through the work stroke distance.

Provided herein are various examples of downhole tools having a tool actuator extending from a packer and having a release stroke distance and a work stroke distance, and a first hydraulic actuator configured to produce forces which are applied to the tool actuator, wherein the first hydraulic actuator is configured such that the forces produced by the first hydraulic actuator are transferred to the tool actuator and amplified hydraulically when the tool actuator is moving through the release stroke distance while setting the packer and the forces produced by the first hydraulic actuator are transferred directly without being amplified hydraulically at the tool actuator when the tool actuator is moving through the work stroke distance while setting the packer, and wherein the work stroke distance is at least three times longer in length than the release stroke distance.

Further downhole tools are provided wherein the first hydraulic actuator is further configured such that the forces produced by the first hydraulic actuator are amplified by a second hydraulic actuator having a small piston head which transfers hydraulic force to a large piston head which pushes against the tool actuator. Further downhole tools are provided further comprising a small piston head configured to move with the hydraulic actuator to force fluid against a large piston head, and a seal which is connected to the tool actuator and contains the large piston head. Further downhole tools are provided further comprising a spring positioned between the second hydraulic actuator and the tool actuator to return the second hydraulic actuator to an original position after the tool actuator moves through the release stroke distance.

Further downhole tools are provided further comprising a releasable coupling positioned between the first hydraulic actuator and the tool actuator which temporarily transfers hydraulic actuator forces to the tool actuator when the tool actuator is moving through the work stroke distance. Further downhole tools are provided wherein the first hydraulic actuator is further configured such that the first hydraulic actuator moves in a same direction as the tool actuator as the tool actuator moves through the release stroke distance and the work stroke distance.

Provided herein are various examples of methods for operating a downhole tool comprising the steps of providing a tool actuator which moves through a release stroke distance and a work stroke distance, moving a first hydraulic actuator to apply forces to the tool actuator, amplifying the forces when the tool actuator is moving through the release stroke distance, and transferring the forces directly from the first hydraulic actuator and without amplification to the tool actuator when the tool actuator is moving through the work stroke distance.

Further methods provide wherein the step of amplifying the forces is performed by a second hydraulic actuator having a small piston head which forces fluid towards a large piston head which causes additional forces to be applied to the tool actuator. Further methods provide wherein the step of amplifying the forces is performed by causing movement of a small piston head area which moves with the first hydraulic actuator to transfer fluid forces to a large piston head area which pushes against the tool actuator. Further methods provide wherein the step of amplifying the forces is performed by piston amplification and the step of transferring the forces directly is performed by engaging a releasable coupling positioned between the first hydraulic actuator and the tool actuator. Further methods provide forcing the second hydraulic actuator back to a previous position after the step of amplifying the forces has been performed.

100 platform
105 sea level
110 production riser
115 blow out preventer (BOP)
120 tubing hanger
125 well system
130 well casing
135 power conductor
140 hydraulic control/injection lines
145 formation
150 open hole section (ie. no casing)
155 data acquisition and control unit
160 electrical umbilical
165 seabed
180 downhole tool
185 work string
200 tool body
205 actuator electronics
210 motor control electronics (eg. motor controller(s))
215 electrical conductors to other motors and their rotational feedback sensors
220 electrical conductors to motor and body position sensor 280
225 motor rotational feedback sensor (eg. hall sensors, resolver, encoder or similar)
230 motor
235 gearbox
240 output shaft
245 screw
250 coupling
255 tool actuator
260 flow ports
265 bore
270 additional motor assembly
280 body position sensor
290 mandrel
470 first hydraulic actuator
471 mechanical shifting rod
480 ball
490 gap
500 packer
550 second hydraulic actuator
575 fluid chamber
580 piston
585 actuator piston head
590 seal piston head
595 spring
600 seal
601 fixed wall
602 spacer
620 mechanical coupling
630 seal
640 fluid
650 small piston head
660 release stroke distance
666 sliding latch
670 work stroke distance
680 large piston head
685 seal
700 shoulder
710 shoulder
720 overlapping portion
730 releasable coupling
740 collet
750 groove FIG. 1 illustrates a schematic view of a well system 125 that may employ the principles of the present disclosure within one or more downhole tools 180.

A platform 100 may be positioned on the surface of the sea and held at sea level 105. Alternatively, the embodiments herein can also be practiced with land-based drilling and well production, where the sea level 105 would instead be ground level. A blow out preventer (BOP) 115 may be positioned on the sea bed 165 with a production riser 110 connected to the BOP 115. A tubing hanger 120 may be positioned at the sea bed 165 to support the well casing 130. An power conductor 135 may then run down the work string 185 and will connect to the internal components of the downhole tool 180 as will be described further below. In some embodiments, the power conductor 135 contains an electrical conductor to deliver electrical power to the downhole tools 180. In other embodiments, the power conductor 135 contains a hydraulic conduit to deliver hydraulic power to the downhole tool 180.

Generally speaking, a series of well casings 130 may be connected and run through the wellbore until the deepest part of the wellbore which lacks any casing which is also referred to as the open hole section 150 of the well, typically in a desirable area of a geological formation 145. The embodiments herein provide for downhole tools 180 which can be used in any section of a well including both the sections that include well casings 130 or sections which are open hole sections 150.

Figure 2:
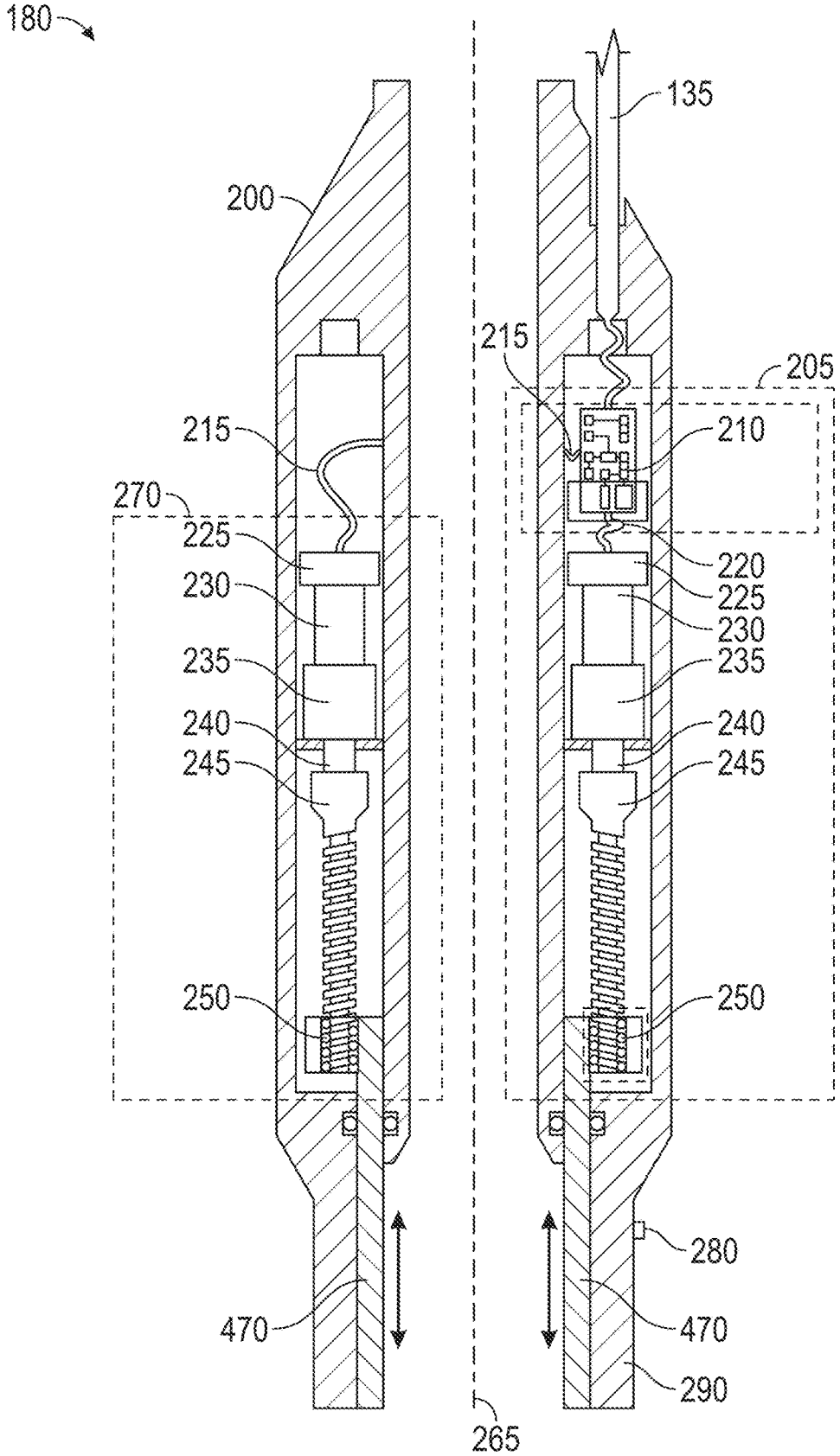
FIG. 2 illustrates a cross-sectional side view of a downhole tool having a traditional screw used for the hydraulic actuator with a sliding tool actuator.

FIG. 2 illustrates a cross-sectional side view of one embodiment of a downhole tool 180 having one or more motors along with an embodiment of the motor control system. The power conductor 135 may traverse through the work string 185 until entering the tool body 200 and connecting with the actuator electronics 205 (or hydraulics) which may contain a motor controller 210. An electrical conductor (or multiple conductors) 220 may exit the actuator electronics 205 to connect with a motor 230 and various sensors within the downhole tool 180 including but not limited to a motor rotational feedback sensor 225. The output shaft of the motor 230 may then be connected to a gearbox 235 which has an output shaft 240 that connects to some type of mechanical body, in this embodiment a screw 245 may be threaded into a coupling 250. In alternative embodiments, the mechanical body could be a valve or the output shaft 240 may itself be the mechanical body. In other embodiments, a power conductor 135 may not be used and the downhole tool may be powered using a downhole power source such as a battery, capacitor, a downhole energy harvester or similar.

Here, a first hydraulic actuator 470 may be connected to the coupling 250 such that rotation of the screw 245 may cause a linear translation of the first hydraulic actuator 470 to reveal one or more flow ports 260. The downhole tool 180 also preferably includes a bore 265 that runs down the central axis of the downhole tool 180. In some embodiments, a body position sensor 280 may be positioned near the mechanical body that is connected to the gearbox 235 to determine the position of the mechanical body. In this embodiment, the body position sensor 280 may be positioned to determine the linear position of the first hydraulic actuator 470 (which may be mechanically coupled to a tool actuator as it extends and retracts to cover the plurality of flow ports 260 as shown and described further below). This sensor 280 can provide feedback to the control system of the present location of the first hydraulic actuator 470 or tool actuator 255 (or other mechanical body), allowing it to confirm movement when the first hydraulic actuator 470 or tool actuator 255 is being moved and to stop the movement at the intended location.

Similarly, embodiments of the downhole tool 180 can contain one or more additional motor assemblies 270 including the following components: motor rotational feedback sensor 225, motor 230, gearbox 235, screw 245, and coupling 250. In some embodiments, each additional motor assembly 270 may be connected to its own first hydraulic actuator 470 or tool actuator 255 or in other embodiments each motor assembly may also connect to the same tool actuator 255.

While the embodiments herein may show the use of an interval control valve or sliding tool actuator, one of ordinary skill in the art can also apply this system to ball valves, safety valves, packers, bridge plugs, and others without substantial modifications and it would be within the scope of this disclosure. In this embodiment, the first hydraulic actuator 470 may include the screw 245 and sometimes the coupling 250 but it should be understood that the disclosure herein can be practiced with any type of hydraulic actuator including but not limited to: mechanical/electromechanical hydraulic actuators, hydraulic actuators, pneumatic hydraulic actuators, piezoelectric actuators, electrohydraulic actuators and others. Electromechanical hydraulic actuators can further be of various types-some consist of a motor, gearbox and ball screw, others use an electrically powered pump to drive a linear piston. Yet others may use electromagnetism whereby the polarity of an electromagnet may be manipulated to drive a magnetic member forward or backwards.

Figure 3:
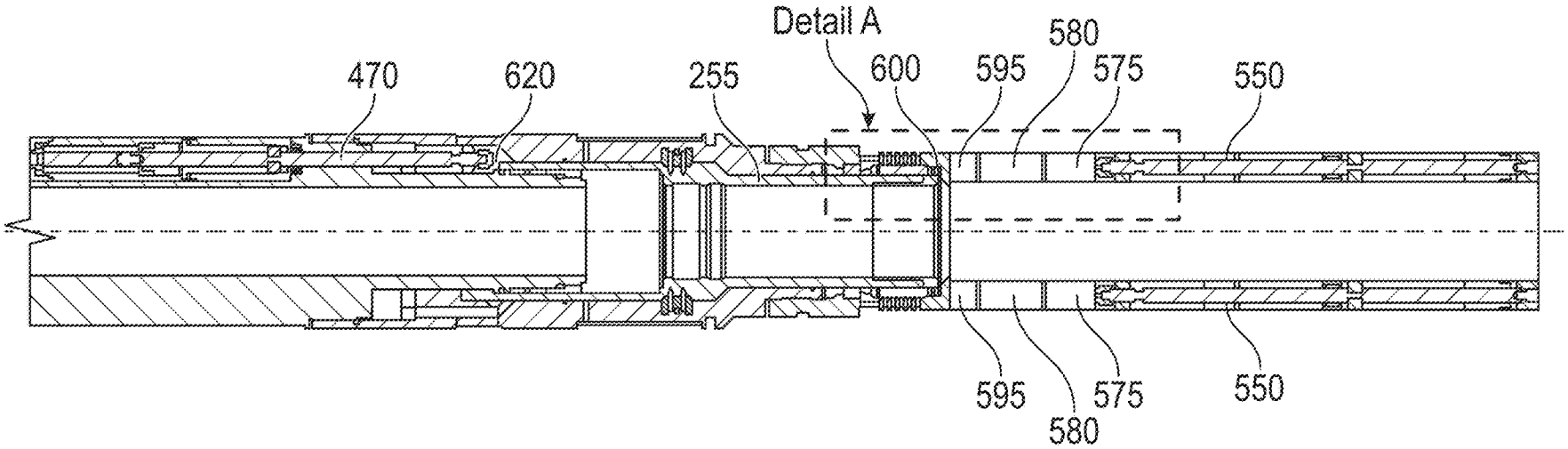
FIG. 3 illustrates a cross-sectional side view of a downhole tool having a hydraulic actuator with piston amplification and showing the location of Detail A.

FIG. 3 illustrates a cross-sectional side view of a downhole tool having a hydraulic actuator with piston amplification and showing the location of Detail A. A first hydraulic actuator 470 may be connected through mechanical coupling 620 to a tool actuator 255 which may form part of a seal 600 at an end of the tool actuator 255. In other embodiments, seal 600 may be a metal-to-metal seal or any other type of seal such as a elastomeric seal, composite seal, vee packing and similar. A second hydraulic actuator 550 may be used during a portion of the stroke of the tool where higher forces may be required. The second hydraulic actuator 550 may be at least partially within a fluid chamber 575 which may be in fluid communication with a piston 580. Piston 580 may be in physical contact with tool actuator 255 through the spacer 602.

Figure 4:
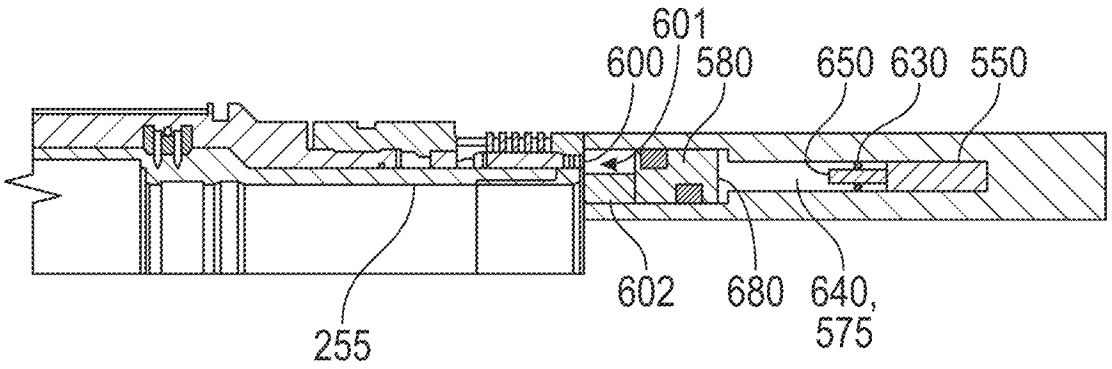
FIG. 4 illustrates a detailed cross-sectional side view of Detail A shown in FIG. 3 where the tool is releasing from the metal to metal seal.

FIG. 4 illustrates a detailed cross-sectional side view of Detail A shown in FIG. 3 where the tool is releasing from the seal 600. The second hydraulic actuator 550 may have a small piston head 650 at one end where the movement of the second hydraulic actuator 550 causes movement of the small piston head 650 which causes a flow of fluid 640 which is contained within the fluid chamber 575. The flow of fluid 640 may then contact the large piston head 680 of the piston 580 resulting in a force much larger than the force output of second hydraulic actuator 550 per Pascal's law.

Figure 5A:
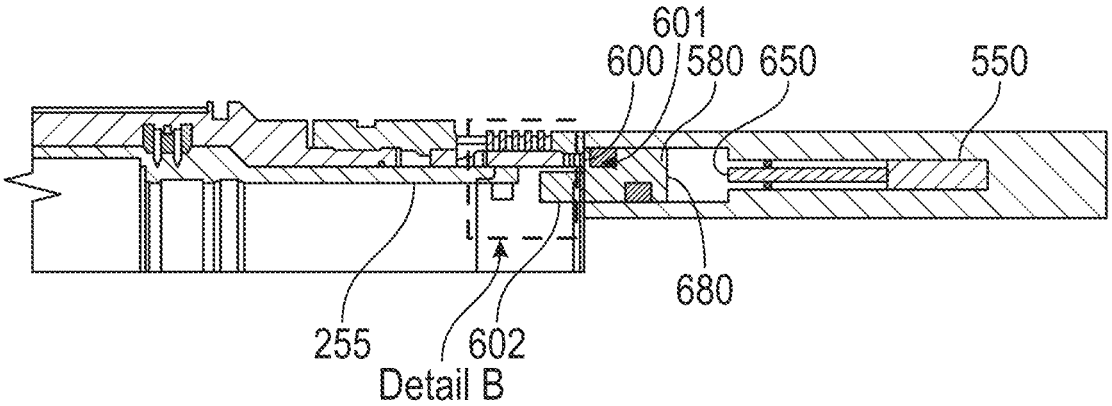
FIG. 5A illustrates a detailed cross-sectional side view of Detail A shown in FIG. 3 where the tool has fully released from the metal to metal seal and is now beginning the work stroke distance, additionally where the location for Detail B is shown.

FIG. 5A illustrates a detailed cross-sectional side view of Detail A shown in FIG. 3 where the tool has fully released from the seal 600 and is now beginning the work stroke, additionally where the location for Detail B is shown. In this position, piston 580 has pushed tool actuator 255 (via the optional spacer 602) from underneath seal 600 with a much larger force than what second hydraulic actuator 550 is able to produce with the trade-off. Per Pascal's law generally, the force generated by second hydraulic actuator 550 F creates a pressure P in the fluid chamber 575 whereby $P=F/A1$ with A1 being the area of small piston head 650. This pressure then acts on piston 580 and since the area of its large piston head 680 is much larger than A1, the force generated is $P*A2=F*(A2/A1)$ resulting is a larger force output. The trade-off is that if the force is multiplied 10X, then second hydraulic actuator 550 must travel 10X the distance travelled by piston 580 and tool actuator 255.

Figure 5B:
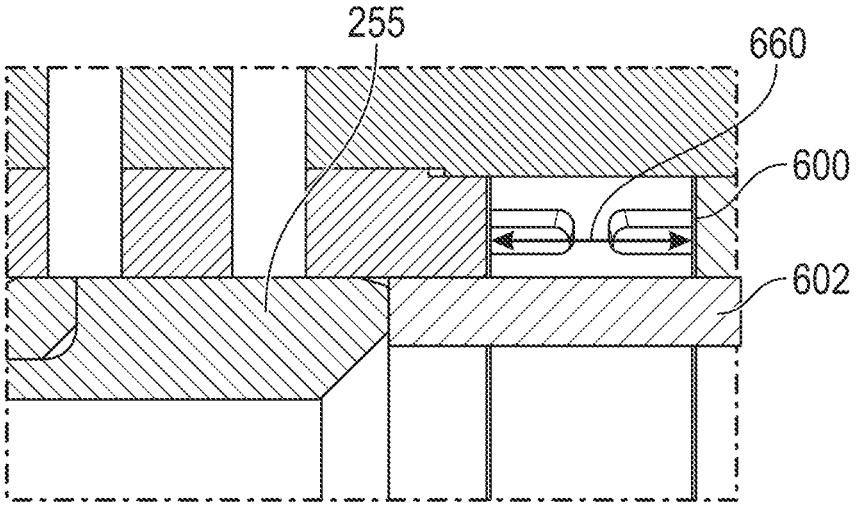
FIG. 5B illustrates a detailed cross-sectional side view of Detail B shown in FIG. 5A.

FIG. 5B illustrates a detailed cross-sectional side view of Detail B shown in FIG. 5A. In some applications, the forces required to remove the tool actuator 255 from the seal 600 are high, while the forces required to then stroke the tool actuator 255 through its full work stroke distance are low. In this release position, the tool actuator 255 has been removed from seal 600 only enough so that it has fully released from the seal 600, this distance can be referred to as the release stroke distance 660. Generally speaking, the release stroke distance 660 could be any distance greater than zero, but in practice it may be a short distance on the order of one to five inches to ensure full release.

Figure 6A:
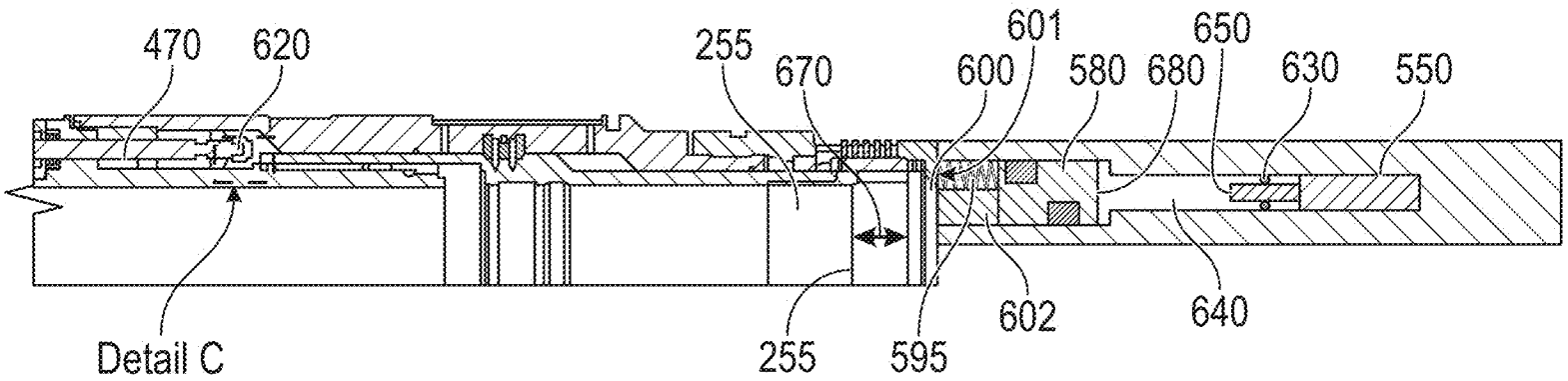
FIG. 6A illustrates a detailed cross-sectional side view of Detail A shown in FIG. 3 where the tool has completed the work stroke distance and the second actuator is returned to its original position, additionally where the location for Detail C is shown.

FIG. 6A illustrates a detailed cross-sectional side view of Detail A shown in FIG. 3 where the tool is continuing to move the tool actuator 255 through its work stroke distance 670 while at the same time (or separately) the second hydraulic actuator 550 may returned to its original position as it is no longer needed for the work stroke, additionally where the location for Detail C is shown. Once the tool has completed the full work stroke portion or otherwise at any point after the release stroke, the optional spring 595 can extend which can push the piston 580 back towards the second hydraulic actuator 550 until it returns to its original position, or near a previous position. The spring 595 may have a first side which contacts the piston 580 and an opposing second side which contacts a fixed wall 601 that is part of the downhole tool. The previous release stroke of the actuator may force the piston 580 to compress the spring 595 against fixed wall 601 whilst simultaneously pushing on tool actuator 255 to remove it from under seal 600. One skilled in the art will recognize that whilst the spring is useful, it is not strictly needed as piston 580 could be pressure balanced on both sides with wellbore pressure so the act of retracting second hydraulic actuator 550 would cause the downhole pressure to push the piston back to its original position.

The first hydraulic actuator 470 may be directly connected to the tool actuator 255 through the mechanical coupling 620 and thus cause the movement of the tool actuator 255 through the work stroke distance 670.

Figure 6B:
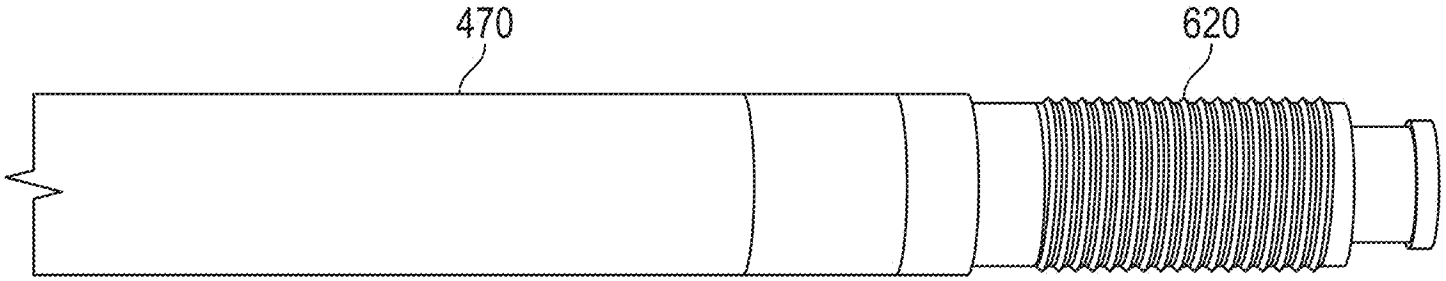
FIG. 6B illustrates a detailed cross-sectional side view of Detail C shown in FIG. 6A.

FIG. 6B illustrates a detailed cross-sectional side view of Detail C showing one type of mechanical coupling 620 showing threads at the end of the first hydraulic actuator 470 and thread into corresponding threads on the tool actuator 255. Of course there are many ways to provide the mechanical coupling 620 in addition to this including welding, pins, collet, and shear pin or similar.

Figure 7:
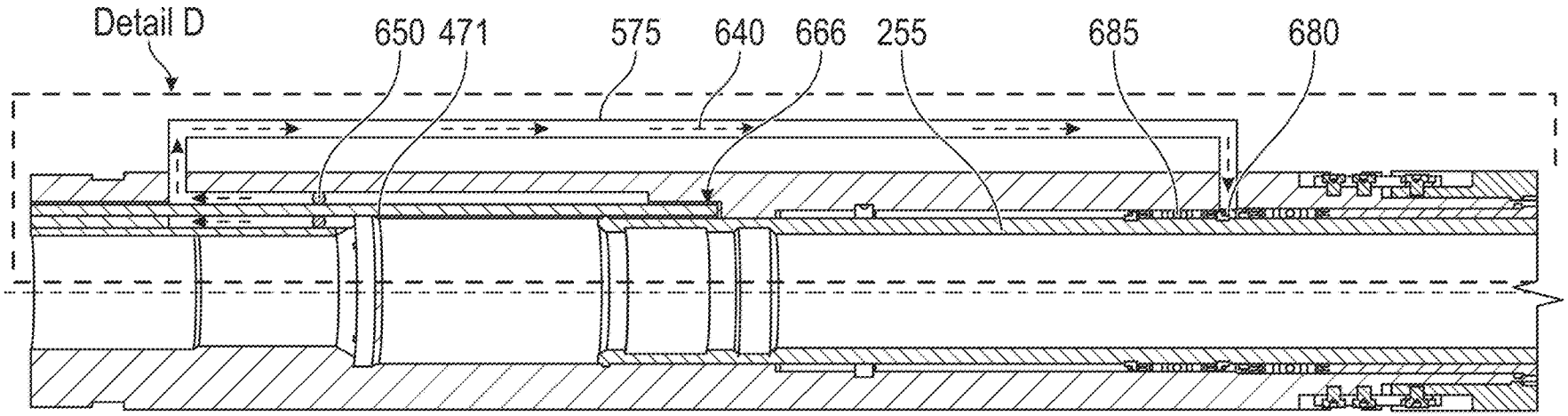
FIG. 7 illustrates a cross-sectional side view of another downhole tool comprising a hydraulic actuator with piston amplification and showing the location of Detail D.

FIG. 7 illustrates a cross-sectional side view of another downhole tool comprising a hydraulic actuator with piston amplification and showing the location of Detail D. In this example, the first hydraulic actuator 470 pulls on a mechanical shifting rod 471 which may contain a small piston head 650. The first hydraulic actuator 470 is not shown within the space of FIG. 7. The seals of small piston head 650 translate as the mechanical shifting rod 471 is translated. The small piston head 650 may be in fluid communication with a large piston head 680 which is connected to a seal 685. Movement of the small piston head 650 may cause a flow of the fluid 640 to produce a hydraulic force against the large piston head 680 which may cause movement of the seal 685. The tool actuator 255 may be attached to the seal 685 such that movement of the seal 685 causes direct movement of the tool actuator 255. Due to the size difference in the piston heads, the force exerted by the mechanical shifting rod 471 is amplified on the tool actuator 255. This same hydraulic leveraging results in the mechanical shifting rod 471 moving a greater distance than the tool actuator 255. The relative motion between the mechanical shifting rod 471 and the tool actuator 255 is accommodated by the sliding latch 666.

Figure 8A:
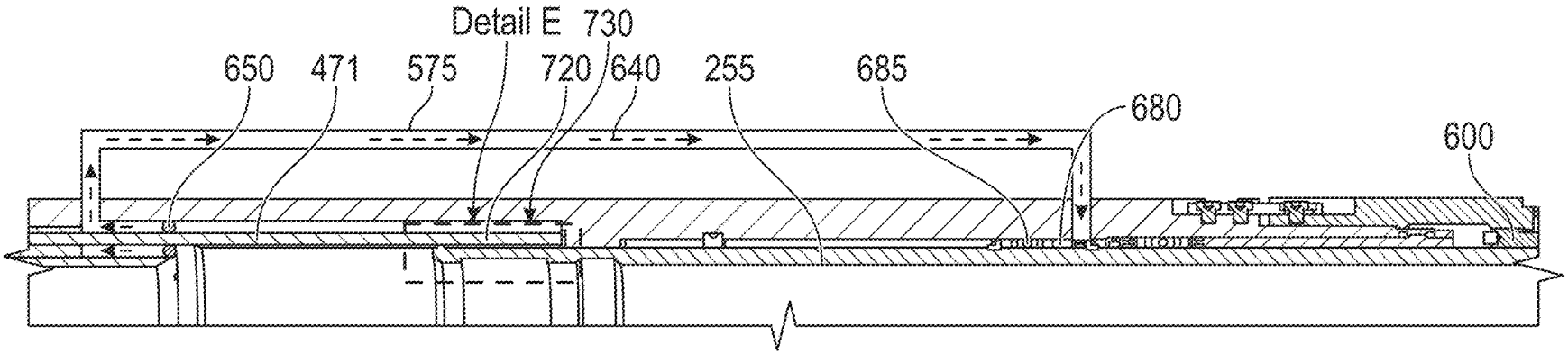
FIG. 8A illustrates a detailed cross-sectional side view of Detail D where the tool is releasing from the metal to metal seal.

FIG. 8A illustrates a detailed cross-sectional side view of Detail D where the tool is releasing from the seal 600. The tool actuator 255 and the mechanical shifting rod 471 may each have a portion that overlaps a portion of the other and these two portions taken together may referred to as the overlapping portion 720 of two components. This overlapping portion 720 encompasses the sliding latch 666 of FIG. 7. The fluid 640 may be forced through the fluid chamber 575 to create hydraulic forces against the large piston head 680, and since the area of the small piston head 650 is preferably smaller than the area of the large piston head 680, the forces of the first hydraulic actuator 470 may be amplified and transferred hydraulically to the tool actuator 255 (through the seal 685 and its connection with the tool actuator 255).

Figure 8B:
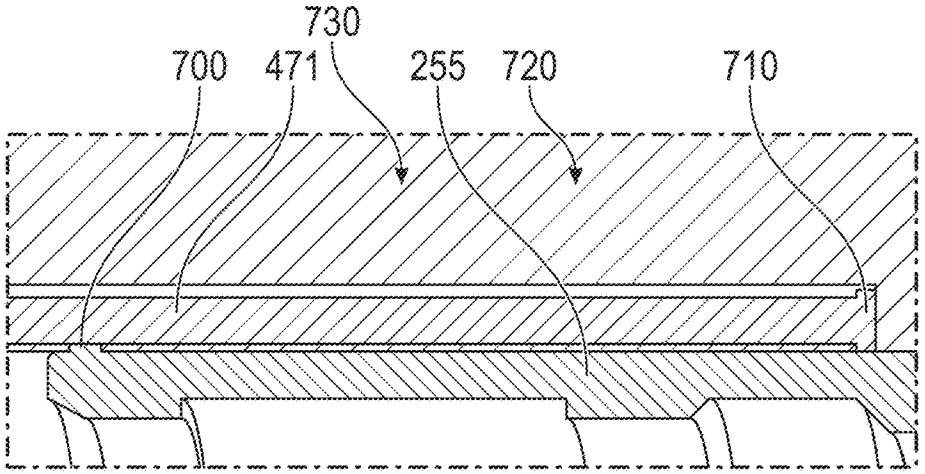
FIG. 8B illustrates a detailed cross-sectional side view of Detail E where the tool actuator and the actuator utilize one type of releasable coupling, which has not been engaged.

FIG. 8B illustrates a detailed cross-sectional side view of Detail E where the tool actuator 255 and the mechanical shifting rod 471 utilize one type of releasable coupling 730, which has not been engaged. The releasable coupling 730 here may positioned at an overlapping portion 720 of the tool actuator 255 and the mechanical shifting rod 471 where two end portions of the two components overlap. The tool actuator 255 may contain a shoulder 700 positioned at an end of the tool actuator 255 that overlaps with the mechanical shifting rod 471. The mechanical shifting rod 471 may have a shoulder 710 positioned at an end of the mechanical shifting rod 471 that overlaps with the tool actuator 255. When the tool is in this position, when the releasable coupling 730 is not engaged, there may be a gap in between the shoulder 700 and the shoulder 710, or in other words the shoulder 700 may be separated from the shoulder 710.

Figure 8C:
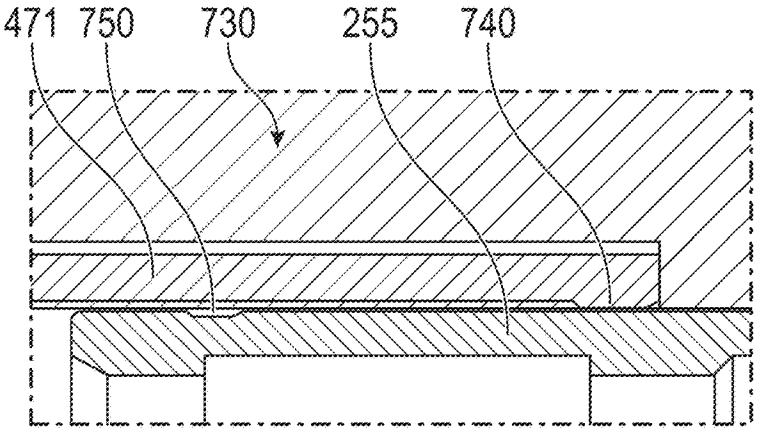
FIG. 8C illustrates a detailed cross-sectional side view of Detail E where the tool actuator and the actuator utilize another type of releasable coupling, which has not been engaged.

FIG. 8C illustrates a detailed cross-sectional side view of Detail E where the tool actuator 255 and the mechanical shifting rod 471 utilize another type of releasable coupling 730, which has not been engaged. In this embodiment, a collet 740 may extend from either the tool actuator 255 or the mechanical shifting rod 471, shown in this embodiment extending from the mechanical shifting rod 471. A corresponding groove 750 may be positioned on either the tool actuator 255 or the mechanical shifting rod 471, shown in this embodiment positioned on the tool actuator 255. As will be discussed further below, the mechanical shifting rod 471 and tool actuator 255 may be permitted to slide along one another until the collet 740 is adjacent to the groove 750.

Figure 9A:
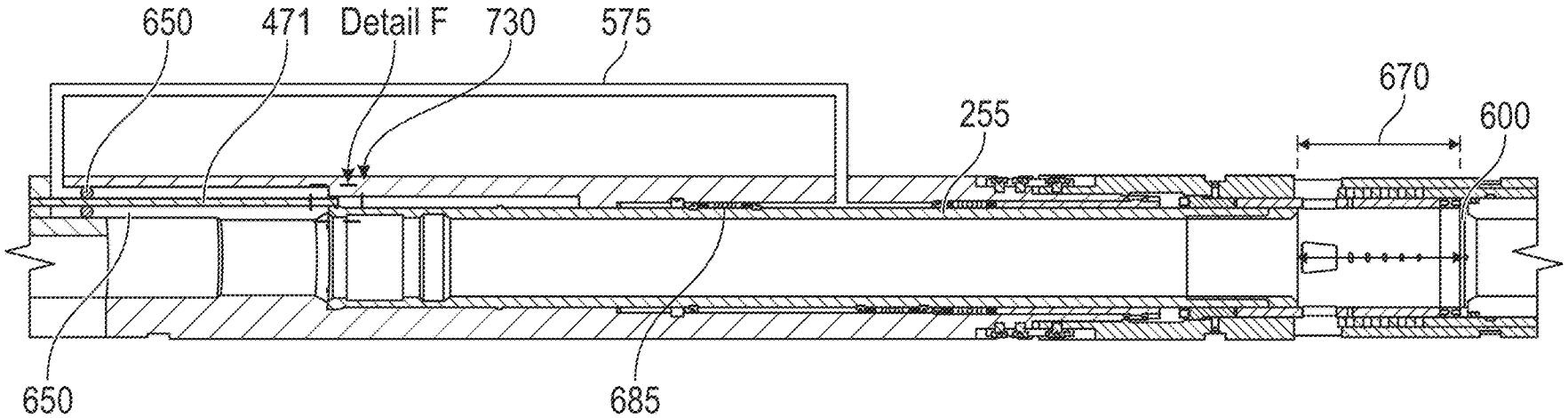
FIG. 9A illustrates a detailed cross-sectional side view of Detail D where the tool has released from the metal to metal seal and the tool is now performing the work stroke distance and also showing the location of Detail F.

FIG. 9A illustrates a detailed cross-sectional side view of Detail D where the tool has released from the seal 600 and the tool is now performing the work stroke distance 670 and also showing the location of Detail F. The tool actuator 255 has now fully released from the seal 600 and is moving in direct contact with the mechanical shifting rod 471. When in this position, there may not be any flow of fluid through the fluid chamber 575 and thus no hydraulic forces on the tool actuator 255. Instead, the forces of the mechanical shifting rod 471 may be directly transferred to the tool actuator 255 to continue the entire desired movement of the tool actuator 255 for the particular operation which may be referred to as the work stroke distance 670. The work stroke distance 670 should be larger than the release stroke distance 660. In some applications the work stroke distance 670 would be at least three times the length of the release stroke distance 660.

Figure 9B:
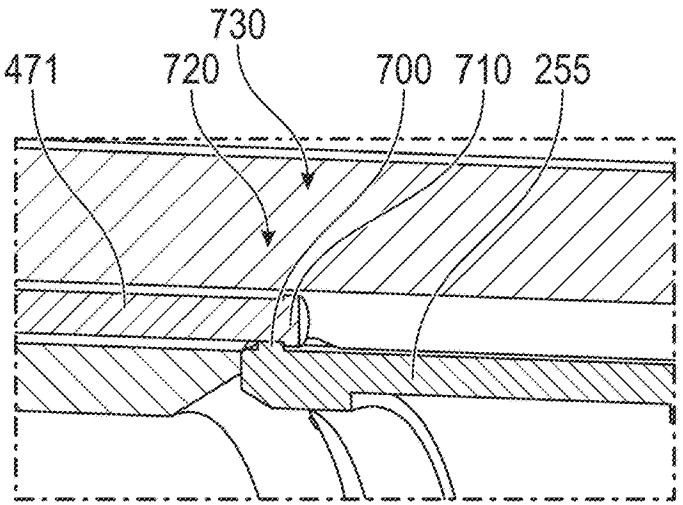
FIG. 9B illustrates a detailed cross-sectional side view of Detail F where the tool actuator and the actuator utilize one type of releasable coupling, which is now engaged.

FIG. 9B illustrates a detailed cross-sectional side view of Detail F where the tool actuator 255 and the mechanical shifting rod 471 utilize one type of releasable coupling 730, which is now engaged. The tool actuator 255 and the mechanical shifting rod 471 may have an overlapping portion 720 that has decreased in size from the overlapping portion 720 that was shown when the tool was releasing from the seal 600. The gap between the shoulder 700 and the shoulder 710 has now been reduced effectively to zero so that the two components are in contact. In this position, the shoulder 700 may be in direct contact with the shoulder 710 such that the tool actuator 255 and the mechanical shifting rod 471 move together. During the movement of the tool actuator 255, the shoulder 700 may remain in direct contact with the shoulder 710. The releasable coupling 730 could then be disengaged when the mechanical shifting rod 471 moves in the opposite direction, ie. moving the shoulder 710 away from the shoulder 700 so that the mechanical shifting rod 471 and the tool actuator 255 could again slide or move relative to one another.

Figure 9C:
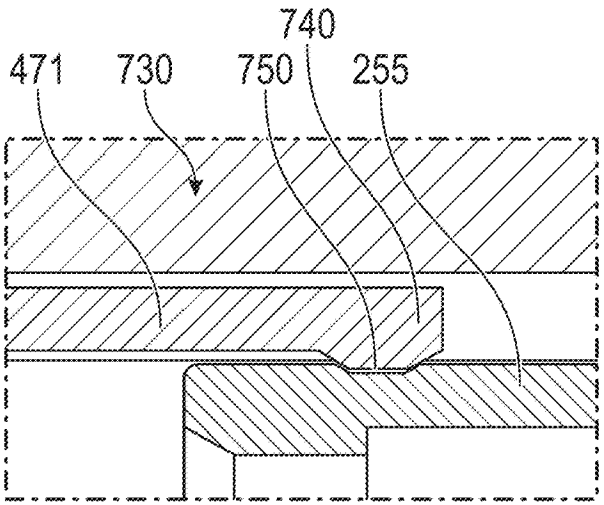
FIG. 9C illustrates a detailed cross-sectional side view of Detail F, and shows the same releasable coupling option as FIG. 8C, where the releasable coupling is now engaged.

FIG. 9C illustrates a detailed cross-sectional side view of Detail F, and shows the same releasable coupling 730 option as FIG. 8C, where the releasable coupling 730 is now engaged. In this position, upon completion of the release stroke, the collet 740 may be positioned adjacent to the groove 750 such that the collet 740 engages with the groove 750 so that the mechanical shifting rod 471 may be temporarily coupled to the tool actuator 255. The groove 750 should be sized to accept the collet 740 such that the collet 740 sits inside the groove 750 and the forces of the mechanical shifting rod 471 may be directly transferred to the tool actuator 255. The releasable coupling 730 could be any mechanism that temporarily transfers forces from the mechanical shifting rod 471 to the tool actuator 255, including but not limited to the examples shown and described herein, and may or may not include a snap ring system, locking dogs, and similar.

Figure 10A:
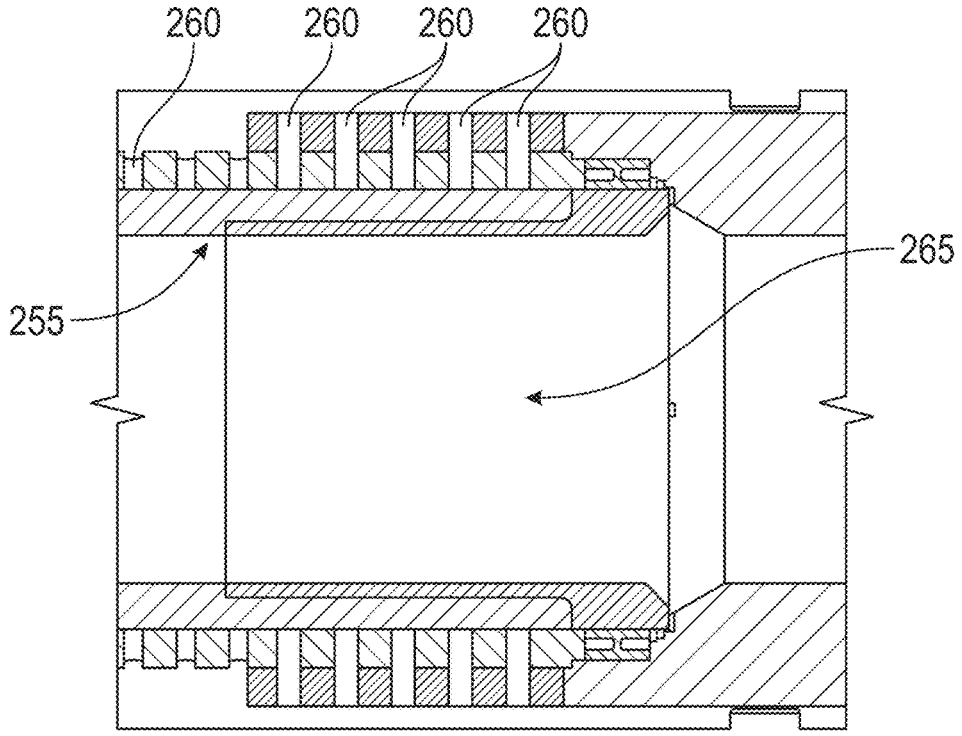
FIGS. 10A through 10D illustrate a cross-sectional side view of an embodiment of the downhole tool where the tool actuator may be moved to cover or expose one or more flow ports.
Figure 10B:
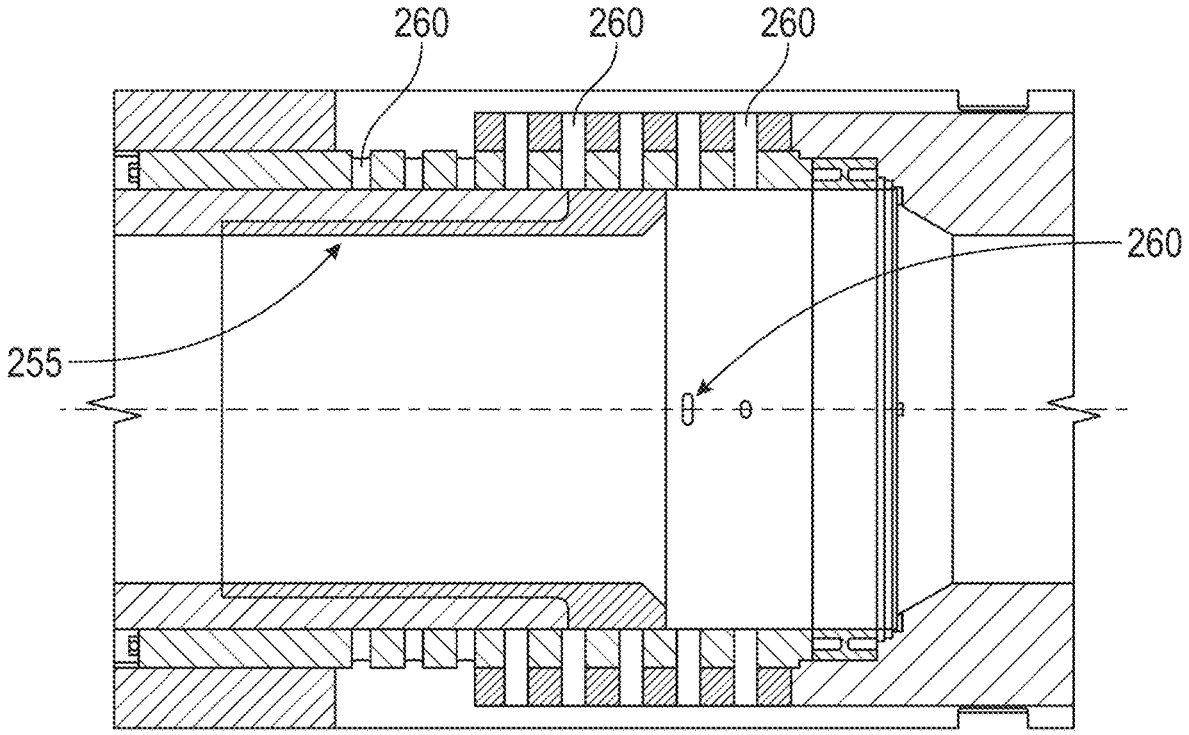
Figure 10C:
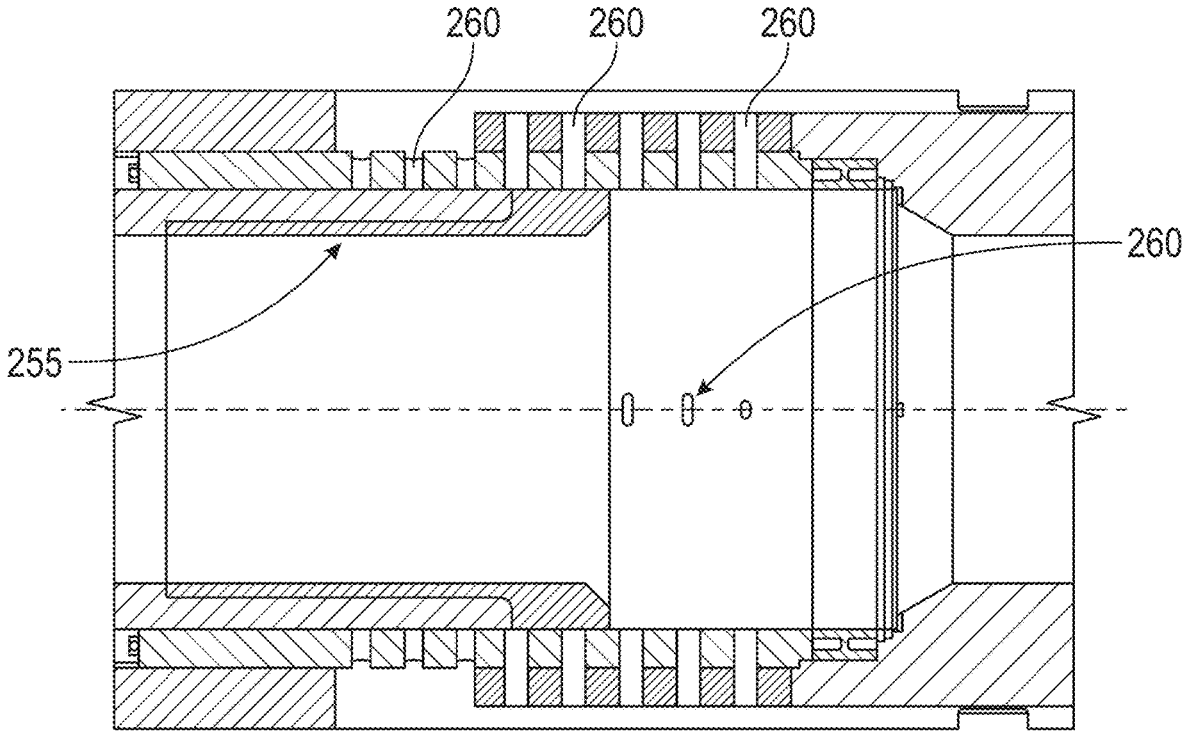
Figure 10D:
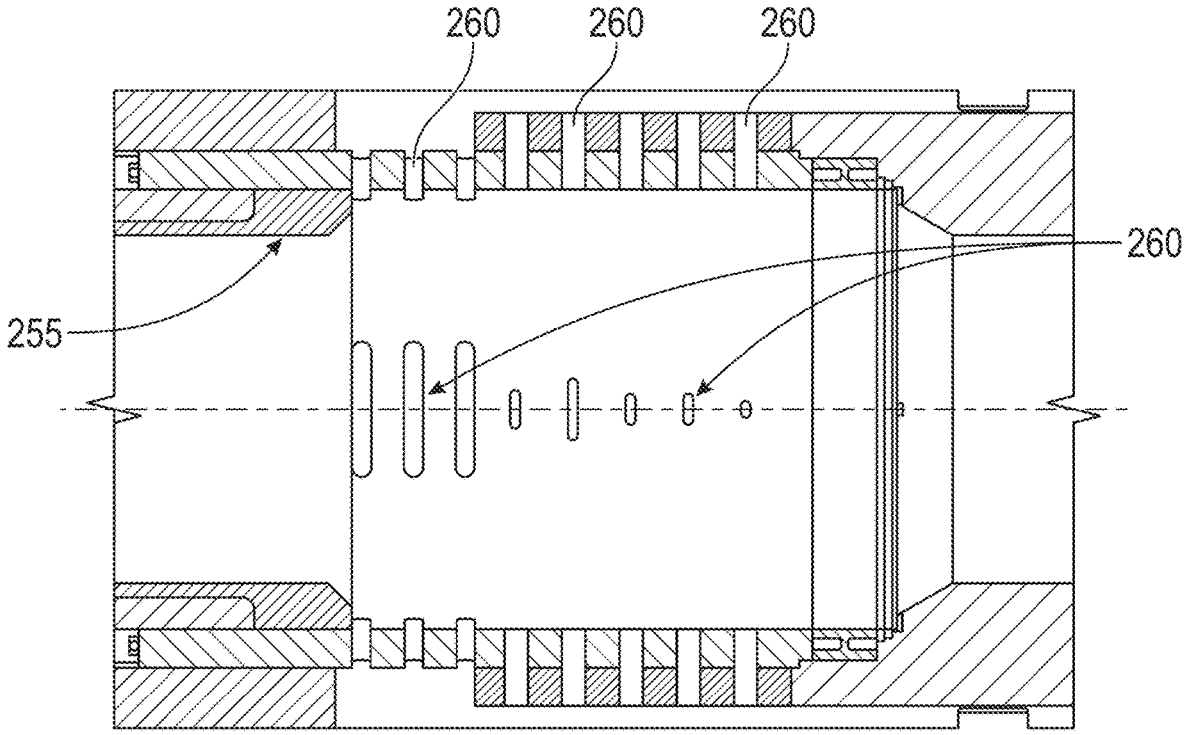

FIGS. 10A through 10D illustrate a cross-sectional side view of an embodiment of the downhole tool where the tool actuator 255 may be moved to cover or expose one or more flow ports 260. In this way, the tool actuator 255 may be used to perform a flow control operation by closing and opening any desired number of flow ports 260. In the closed state of the tool shown in FIG. 10A, the tool actuator 255 is positioned so that all of the flow ports 260 are covered/closed which would prevent fluids passing through the bore 265 of the tool from exiting the interior of the tool. In FIG. 10B, the tool actuator 255 has been moved such that two of the flow ports 260 have been uncovered/opened. In FIG. 10C, the tool actuator 255 has been further moved such that three of the flow ports 260 have been uncovered/opened. In FIG. 10D, the tool actuator 255 has been further moved such that all of the flow ports 260 have been uncovered/opened. This technique allows a precise amount of fluid flow to be controlled by the tool, changeable at any time, even when very large forces may be necessary to move the tool actuator 255 but there is not enough space for a large motor or gear system.

Figure 11B:
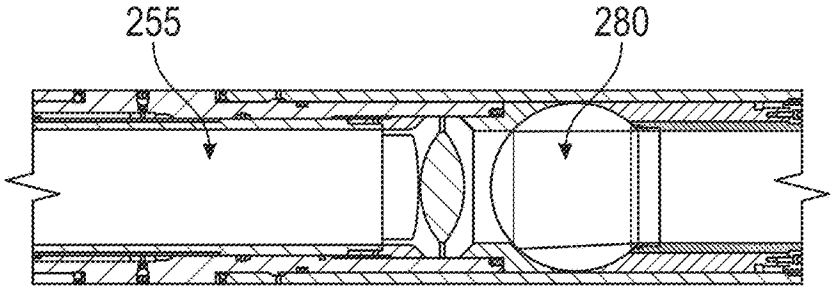
FIGS. 11A through 11B illustrate a cross-sectional side view of an embodiment of the downhole tool where the tool actuator may be moved in order to move a ball used for a ball valve.
Figure 11A:
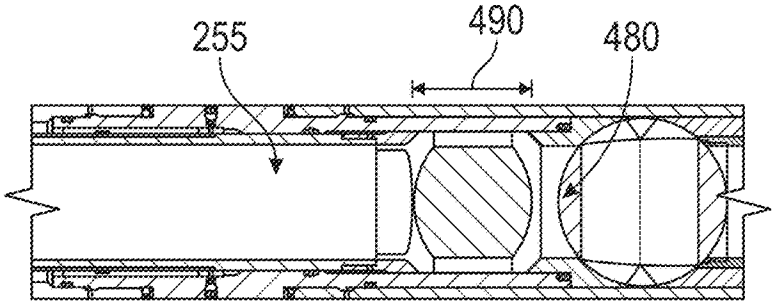

FIGS. 11A through 11B illustrate a cross-sectional side view of an embodiment of the downhole tool where the tool actuator 255 may be moved in order to move a ball 480 used for a ball valve. In these types of valves a ball 480 may be positioned atop a ball seat where the ball 480 can be moved in order to open or close the valve. In FIG. 11A, there is a gap 490 shown between the tool actuator 255 and the ball 480. In FIG. 11B, the tool actuator 255 has moved and in the process the gap 490 has been closed and the ball 480 has been moved to open/close the valve.

Figure 12B:
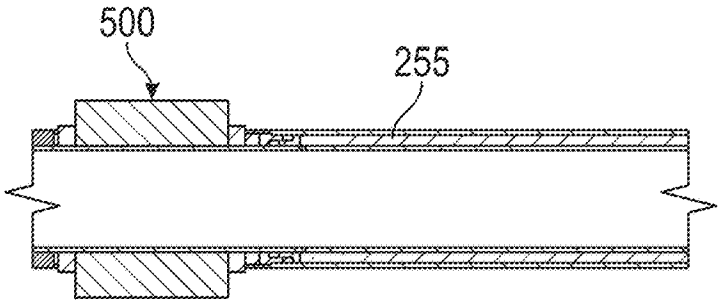
FIGS. 12A through 12B illustrate a cross-sectional side view of an embodiment of the downhole tool where the tool actuator may be moved to expand or contract a packer.
Figure 12A:
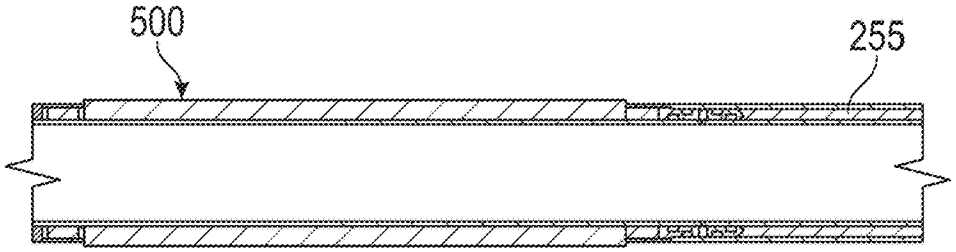

FIGS. 12A through 12B illustrate a cross-sectional side view of an embodiment of the downhole tool where the tool actuator 255 may be moved to expand or contract a packer 500. In FIG. 12A, the packer 500 is shown having its full length, perhaps at a point when the packer 500 is first being sent down hole and the sealing of the wellbore is not yet required. In FIG. 12B, the tool actuator 255 has moved in order to compress the packer 500 along its axis while expanding the packer 500 outwardly to contact the sidewalls of the wellbore and produce a fluid seal within the wellbore if and when desired. This process could then be reversed in order to remove the fluid seal and ultimately the packer 500 from the wellbore.

A person having ordinary skill in the art will recognize that, although not required, in the embodiment(s) where the hydraulic actuator is a motor and gearbox-based actuator, a pressure compensation device may be added so that the motor and gearbox is always pressure balanced with the wellbore. Such a compensation system could be achieved with a floating piston, a bellow, a diaphragm, or any other type of accumulator. It would be advantageous to have this pressure compensation system equalize pressure with the bore 265 so that the seals or seal stacks used on the tool actuator are always pressure balanced. This ensures that the closed fluid volume between the actuator and tool actuator has no reason to ever leak away as it is always pressure balanced except during actuation when the pressure intensification is done.

The tool actuator 255 could be a sleeve or a piston and may also include a hydraulically driven piston that actuates the downhole tool to shift its configuration, such as a sleeve shifting the inflow restriction, or a packer shifting into a setting position, or similar.

The hydraulic actuators 470 and 550 can be considered to be a hydraulic actuator which creates a pressurized fluid flow. Many types of hydraulic actuators can be used including hydraulic pressure delivered from the surface along a hydraulic line or including a hydraulic pump such as provided by the Leduc Company. In some embodiments, the first hydraulic actuator 470 may include the screw 245 and sometimes the coupling 250 but it should be understood that the disclosure herein can be practiced with any type of hydraulic actuator including but not limited to: mechanical/electromechanical hydraulic actuators, hydraulic actuators, pneumatic hydraulic actuators, piezoelectric actuators, electrohydraulic actuators and others. Electromechanical hydraulic actuators can further be of various types-some consist of a motor, gearbox and ball screw, others use an electrically powered pump to drive a linear piston. Yet others may use electromagnetism whereby the polarity of an electromagnet may be manipulated to drive a magnetic member forward or backwards.

The ratios between the relative sizes of the piston head areas and seal areas can have many different arrangements, depending on the particular application. Assuming as a non-limiting example, the ratio of areas between small piston head 650 and large piston head 680 may be 1:10. Using this example, during the high amplification phase the output force of the first hydraulic actuator 470 will now be amplified 10X when applied to the tool actuator 255 (or other element for movement). This example can be carried through various embodiments, including ratios for small piston head 650: large piston head 680 including but not limited to: A) 1:2, B) 1:5, C) 1:10, and D) 1:100 and anything in between.

The term 'high amplified' is used herein to represent an amplification of the force output by the first hydraulic actuator 470 by a factor that is greater than 2× and will generally be in the range from 2× to 100×. The term 'very high amplified' is a subset of the term 'high amplified' and is used herein to represent an amplification of the force output that is 4× or greater. The term 'low amplified' is used herein to represent an amplification that is less than 2× and will generally be in the range from 0.01× to 2×. The term 'not amplified' is a subset of the term 'low amplified' and is used herein to represent amplification of 0.5×-2×. The term 'very low amplified' is a subset of the term 'minimally amplified' and is used herein to represent amplification of less than 0.9×. The term 'amplified' has been used herein to represent any level of amplification above zero.

The term 'force ratio' is used herein to represent the ratio of the force generated in the portion of the actuation stroke where the force is high amplified to the force generated in the portion of the actuation stroke that is low amplified. The term 'high force ratio' is used herein to represent a force ratio that is greater than 2× and will generally be in the range from 2× to 100×. The term 'very high force ratio' is a subset of the term 'high force ratio' and is used herein to represent a force ratio that is 4× or greater. The term 'low force ratio' is used herein to represent a force amplification that is less than 2× and will generally be in the range from 1× to 2×.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A downhole tool comprising:

a tool actuator which moves through a release stroke distance and a work stroke distance; and a first hydraulic actuator configured to produce forces which are applied to the tool actuator; and wherein the first hydraulic actuator is further configured such that the forces produced by the first hydraulic actuator are transferred to the tool actuator and amplified at the tool actuator when the tool actuator is moving through the release stroke distance and the forces produced by the first hydraulic actuator are transferred directly without being amplified at the tool actuator when the tool actuator is moving through the work stroke distance.

2. The downhole tool of claim 1 wherein:

the release stroke distance is measured between a metal to metal seal and the tool actuator.

3. The downhole tool of claim 1 wherein:

the work stroke distance is at least three times longer in length than the release stroke distance.

4. The downhole tool of claim 1 further comprising:

a second hydraulic actuator configured to produce forces which are applied to the tool actuator in addition to the forces produces by the first hydraulic actuator only when the tool actuator is moving through the release stroke distance.

5. The downhole tool of claim 4 wherein:

the second hydraulic actuator is configured such that it does not produce any forces which are applied to the tool actuator when the tool actuator is moving through the release stroke distance.

6. The downhole tool of claim 1 further comprising:

a releasable coupling positioned where a portion of the first hydraulic actuator overlaps with a portion of the tool actuator.

7. The downhole tool of claim 1 further comprising:

a shoulder positioned on the first hydraulic actuator; and another shoulder positioned on the tool actuator and sized to engage with the shoulder on the first hydraulic actuator.

8. The downhole tool of claim 7 wherein:

the first hydraulic actuator slides along the tool actuator when the tool actuator is moving through the release stroke distance; and the shoulder on the first hydraulic actuator catches the shoulder on the tool actuator when the tool actuator is moving through the work stroke distance.

9. The downhole tool of claim 1 further comprising:

a releasable coupling which is disengaged when the tool actuator is moving through the release stroke distance and engaged when the tool actuator is moving through the work stroke distance.

10. A downhole tool comprising:

a tool actuator extending from a packer and having a release stroke distance and a work stroke distance; and a first hydraulic actuator configured to produce forces which are applied to the tool actuator;

wherein the first hydraulic actuator is configured such that the forces produced by the first hydraulic actuator are transferred to the tool actuator and amplified hydraulically when the tool actuator is moving through the release stroke distance while setting the packer and the forces produced by the first hydraulic actuator are transferred directly without being amplified hydraulically at the tool actuator when the tool actuator is moving through the work stroke distance while setting the packer; and wherein the work stroke distance is at least three times longer in length than the release stroke distance.

11. The downhole tool of claim 10 wherein:

the first hydraulic actuator is further configured such that the forces produced by the first hydraulic actuator are amplified by a second hydraulic actuator having a small piston head which transfers hydraulic force to a large piston head which pushes against the tool actuator.

12. The downhole tool of claim 11 further comprising:

a spring positioned between the second hydraulic actuator and the tool actuator to return the second hydraulic actuator to an original position after the tool actuator moves through the release stroke distance.

13. The downhole tool of claim 10 further comprising:

a small piston head configured to move with the first hydraulic actuator to force fluid against a large piston head; and a seal which is connected to the tool actuator and contains the large piston head.

14. The downhole tool of claim 10 further comprising:

a releasable coupling positioned between the first hydraulic actuator and the tool actuator which temporarily transfers hydraulic actuator forces to the tool actuator when the tool actuator is moving through the work stroke distance.

15. The downhole tool of claim 10 wherein:

the first hydraulic actuator is further configured such that the first hydraulic actuator moves in a same direction as the tool actuator as the tool actuator moves through the release stroke distance and the work stroke distance.

16. A method for operating a downhole tool comprising the steps of:

providing a tool actuator which moves through a release stroke distance and a work stroke distance;

moving a first hydraulic actuator to apply forces to the tool actuator;

amplifying the forces when the tool actuator is moving through the release stroke distance; and transferring the forces directly from the first hydraulic actuator and without amplification to the tool actuator when the tool actuator is moving through the work stroke distance.

17. The method of claim 16 wherein:

the step of amplifying the forces is performed by a second hydraulic actuator having a small piston head which forces fluid towards a large piston head which causes additional forces to be applied to the tool actuator.

18. The method of claim 17 further comprising:

forcing the second hydraulic actuator back to a previous position after the step of amplifying the forces has been performed.

19. The method of claim 16 wherein:

the step of amplifying the forces is performed by causing movement of a small piston head area which moves with the first hydraulic actuator to transfer fluid forces to a large piston head area which pushes against the tool actuator.

20. The method of claim 16 wherein:

the step of amplifying the forces is performed by piston amplification and the step of transferring the forces directly is performed by engaging a releasable coupling positioned between the first hydraulic actuator and the tool actuator.

* * * * *